US010418695B2

(12) United States Patent
Kim et al.

(10) Patent No.: US 10,418,695 B2
(45) Date of Patent: Sep. 17, 2019

(54) ANTENNA APPARATUS, METHOD FOR MANUFACTURING THE SAME, AND VEHICLE HAVING THE SAME

(71) Applicants: HYUNDAI MOTOR COMPANY, Seoul (KR); KIA MOTORS CORPORATION, Seoul (KR); HYUNDAI MOBIS CO., LTD., Seoul (KR)

(72) Inventors: Yong Ho Kim, Gunpo-si (KR); Jungook Lee, Gunpo-si (KR); Kyu Han Kim, Yongin-si (KR)

(73) Assignees: Hyundai Motor Company, Seoul (KR); Kia Motors Corporation, Seoul (KR); Hyundai Mobis Co., Ltd., Seoul (KR)

( * ) Notice: Subject to any disclaimer, the term of this patent is extended or adjusted under 35 U.S.C. 154(b) by 104 days.

(21) Appl. No.: 15/187,466

(22) Filed: Jun. 20, 2016

(65) Prior Publication Data

US 2017/0149123 A1 May 25, 2017

(30) Foreign Application Priority Data

Nov. 20, 2015 (KR) ..... 10-2015-0163037

(51) Int. Cl.

| | |
|---|---|
| ***H01Q 1/32*** | (2006.01) |
| ***H01Q 1/12*** | (2006.01) |
| ***H01Q 1/38*** | (2006.01) |
| ***H01Q 21/30*** | (2006.01) |

(52) U.S. Cl.

CPC ..... *H01Q 1/3275* (2013.01); *H01Q 1/1214* (2013.01); *H01Q 1/38* (2013.01); *H01Q 21/30* (2013.01)

(58) Field of Classification Search

CPC ..... H01Q 1/32; H01Q 1/38; H01Q 21/30; H01Q 1/12

USPC ..... 343/713

See application file for complete search history.

(56) References Cited

U.S. PATENT DOCUMENTS

| | | | | |
|---|---|---|---|---|
| 2005/0195124 | A1* | 9/2005 | Puente Baliarda | H01O 1/36 343/893 |
| 2006/0139209 | A1* | 6/2006 | Tanaka | H01O 9/0407 343/700 MS |
| 2007/0126638 | A1* | 6/2007 | Channabasappa | H01O 9/0407 343/700 MS |
| 2008/0218418 | A1* | 9/2008 | Gillette | H01O 1/38 343/700 MS |
| 2009/0224981 | A1* | 9/2009 | Shibata | H01O 9/0407 343/700 MS |

(Continued)

FOREIGN PATENT DOCUMENTS

| | | | |
|---|---|---|---|
| JP | 2013-051492 | A | 3/2013 |
| KR | 10-2001-0105522 | A | 11/2001 |

(Continued)

*Primary Examiner* — Huedung X Mancuso

(74) *Attorney, Agent, or Firm* — Morgan, Lewis & Bockius LLP

(57) ABSTRACT

An antenna apparatus includes a substrate formed of a dielectric material; a pattern unit disposed on one surface of the substrate and radiating energy of electromagnetic wave; and a patch unit disposed on the substrate to be spaced apart from one side of the pattern unit with a first distance and configured to limit radiation of an energy radiated from the one side of the pattern unit.

7 Claims, 17 Drawing Sheets

(56) References Cited

U.S. PATENT DOCUMENTS

| | | | | |
|---|---|---|---|---|
| 2013/0050037 | A1* | 2/2013 | Takemura | H01O 9/0407 343/756 |
| 2016/0056544 | A1* | 2/2016 | Garcia | H01O 21/28 343/725 |
| 2017/0149123 | A1* | 5/2017 | Kim | H01Q 1/3275 |
| 2017/0271767 | A1* | 9/2017 | Nair | H01Q 9/0407 |
| 2017/0346156 | A1* | 11/2017 | Morris | H01Q 1/1285 |

FOREIGN PATENT DOCUMENTS

| | | | |
|---|---|---|---|
| KR | 10-2010-0022759 | A | 3/2010 |
| KR | 2012-0035459 | A | 4/2012 |
| KR | 10-1209567 | B1 | 12/2012 |
| KR | 10-2013-0134793 | A | 12/2013 |
| KR | 10-2014-0136079 | A | 11/2014 |

* cited by examiner

ANTENNA APPARATUS, METHOD FOR MANUFACTURING THE SAME, AND VEHICLE HAVING THE SAME

CROSS-REFERENCE TO RELATED APPLICATION(S)

This application claims the benefit of priority to Korean Patent Application No. 10-2015-0163037, filed on Nov. 20, 2015 in the Korean Intellectual Property Office, the disclosure of which is incorporated herein by reference.

TECHNICAL FIELD

The present disclosure relates to an antenna apparatus for extension of radiation area, a method for manufacturing the same, and a vehicle having the same.

BACKGROUND

An intelligent vehicle may include at least one of an ultrasound sensor, an image sensor, a laser sensor, and a LiDAR sensor, all of which are replaceable with human sight. The intelligent vehicle may be an autonomous vehicle configured to automatically drive without a driver's operation while collecting information related to driving of the vehicle, and recognizing an object, e. g. obstacles around the vehicle by using at least one sensor. Accordingly, when the driver could not correctly recognize a road condition, due to driver's negligence, mistake, and the limitation of the sight, the vehicle may help the recognition of the road condition, and thus, an accident may be prevented.

Due to the development in the sensor and antenna technology, the intelligent vehicle may receive driving information of adjacent vehicles, road condition information, emergency message information between vehicles, as well as route guide and traffic jam information through intelligent transportation system (ITS) service, and the intelligent vehicle may control the driving based on the received information.

When the intelligent vehicle communicates with the ITS using an external antenna apparatus, there may be eccentricity caused by a metal in a roof panel.

When vehicles communicate each other, the eccentricity may cause a shorting effective communication range and leading to poor communication since an antenna of a host vehicle is not focused on a partner vehicle.

The external antenna apparatus may be an omnidirectional antenna and may transmit radiant energy to an upper side of a vehicle body as well as a front side and a rear side of the vehicle itself. Therefore, some of the radiant energy may be wasted, and thus, a radiation area may be reduced.

SUMMARY

An aspect of the present disclosure provides an antenna apparatus for extending a radiation area horizontally using a parasitic patch, a method for manufacturing the same, and a vehicle having the same.

Another aspect of the present disclosure provides a vehicle capable of communicating with another vehicle using an antenna apparatus in which a radiation area horizontally extends, and capable of controlling a driving based on the communication with the other vehicle.

Additional aspects of the present disclosure will be set forth in part in the description which follows, and in part, will be obvious from the description, or may be learned by practice of the present disclosure.

In accordance with one embodiment in the present disclosure, an antenna apparatus includes: a substrate formed of a dielectric material; a pattern unit disposed on one surface of the substrate and radiating energy of electromagnetic wave; and a patch unit disposed on the substrate to be spaced apart from one side of the pattern unit with a first distance and limiting radiation of an energy radiated from one side of the pattern unit.

The antenna apparatus may further include a ground plate provided in one surface and another surface of the substrate and formed of conductive material.

The certain distance may be determined based on a height of the pattern unit and a width of the patch unit.

The first distance may be from approximately 1 mm to 2.1 mm.

The pattern unit may include a first pattern connected to a driving module; a second pattern having a longer width length and a longer height length than the first pattern; and a third pattern having a longer width h and a shorter height than the second pattern.

The patch unit may be spaced apart from the third pattern with a certain distance.

The antenna apparatus may further a ground plate disposed on a second surface of the substrate and a supporting unit disposed between the substrate and the patch unit.

In accordance with another embodiment in the present disclosure, a method for manufacturing an antenna apparatus includes designing a pattern unit and a patch unit on a first surface of a substrate having a thin film on the first surface and a second surface of the substrate; forming the pattern unit and the patch unit on the first surface of the substrate by removing the remaining area of a first design area in which the pattern unit and the patch unit are designed, in the thin film of the first surface of the substrate; designing a ground plate on a thin film of the second surface of the substrate; and forming the ground plate on the second surface of the substrate by removing the remaining area of a second design area in which the ground plate is designed, in the thin film of the second surface of the substrate.

The removal of the remaining area of the first surface and the second surface may include removing by an etching technology.

The design of the pattern unit and the patch unit may include designing the pattern unit and the patch unit to be spaced apart from each other with a certain distance.

In accordance with another embodiment in the present disclosure, a vehicle includes: a body; an antenna apparatus mounted to a roof panel of the body and configured to communicate with at least one of another vehicle, a server, and a base station; a controller configured to acquire road condition information through a signal processing a signal received through the antenna apparatus; and an output configured to output the acquired road condition information, wherein the antenna apparatus may include a substrate; a pattern unit disposed on a first surface of the substrate and radiating energy of electromagnetic wave; a patch unit disposed on the first surface of the substrate to be spaced apart from one side of the pattern unit with a certain distance and limiting radiation of an energy radiated from the one side of the pattern unit; and a ground plate disposed on a second surface of the substrate.

The vehicle may further include a driving module provided with the controller and the antenna apparatus disposed vertically thereto and electrically connected thereto.

The antenna apparatus may include two antennas wherein the two antennas may be disposed in a way that a surface having a ground plate faces to each other.

The two antennas may be disposed to be spaced apart from each other with a distance that is to avoid an interference with each other.

The vehicle may further include an antenna disposed on the driving module and configured to receive at least one of a radio signal, a broadcast signal, and a satellite signal.

The pattern unit may include a first pattern connected to the driving module; a second pattern having a longer width length and a longer height length than the first pattern; and a third pattern having a longer width length and a shorter height length than the second pattern.

The patch unit may be spaced apart from the third pattern with a certain distance to limit an energy radiated toward an upper side.

The vehicle may further include an information collector configured to collect driving information and road condition information, wherein the controller may control to transmit the collected information through the antenna apparatus.

The antenna apparatus may include a bottom member mounted to the roof panel; a base member disposed on the bottom member and to which a driving module is mounted; and a cover member coupled to the bottom member.

The patch unit may radiate energy toward the front side and the rear side of the body.

BRIEF DESCRIPTION OF THE DRAWINGS

These and/or other aspects of the disclosure will become apparent and more readily appreciated from the following description of embodiments.

DETAILED DESCRIPTION

The present disclosure will be described more fully hereinafter with reference to the accompanying drawings, in which exemplary embodiments in the disclosure are shown.

Figure 1:
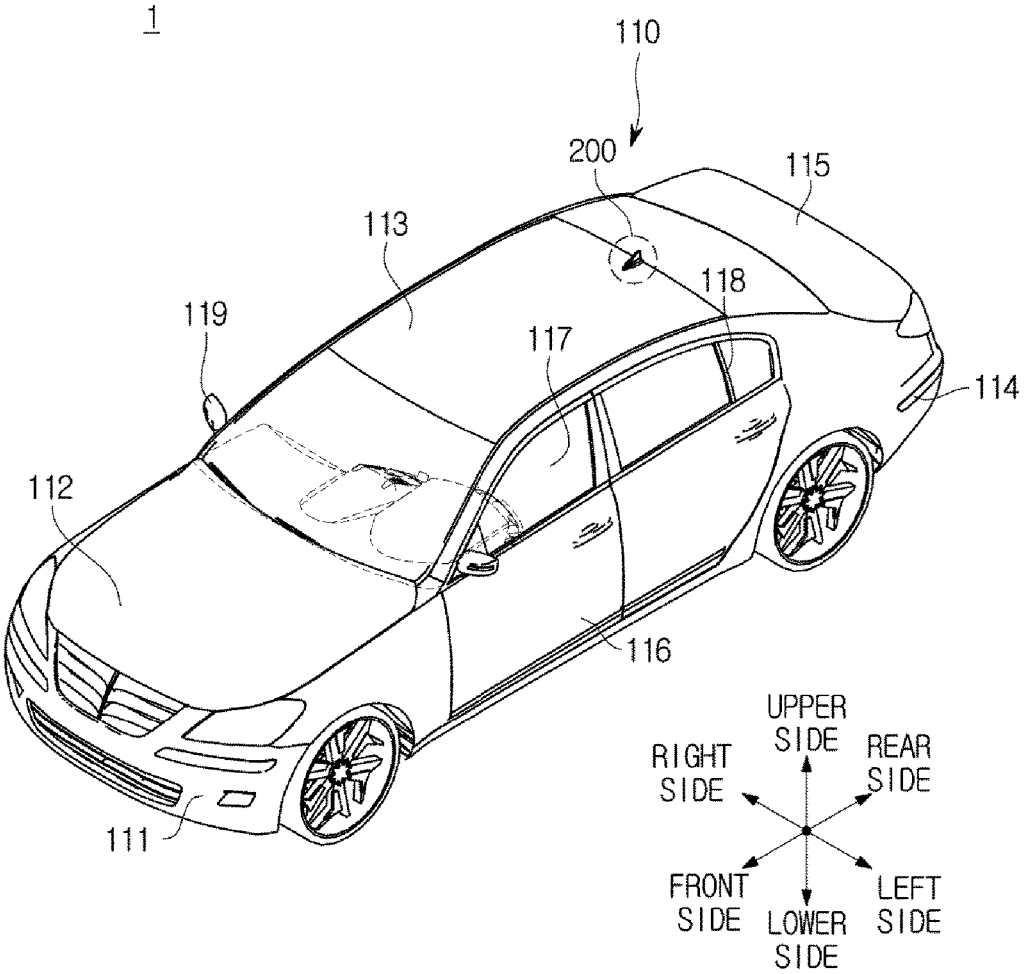
FIG. 1 is an exemplary view of a vehicle, in which an antenna in accordance with an embodiment in the present disclosure is provided.
Figure 2:
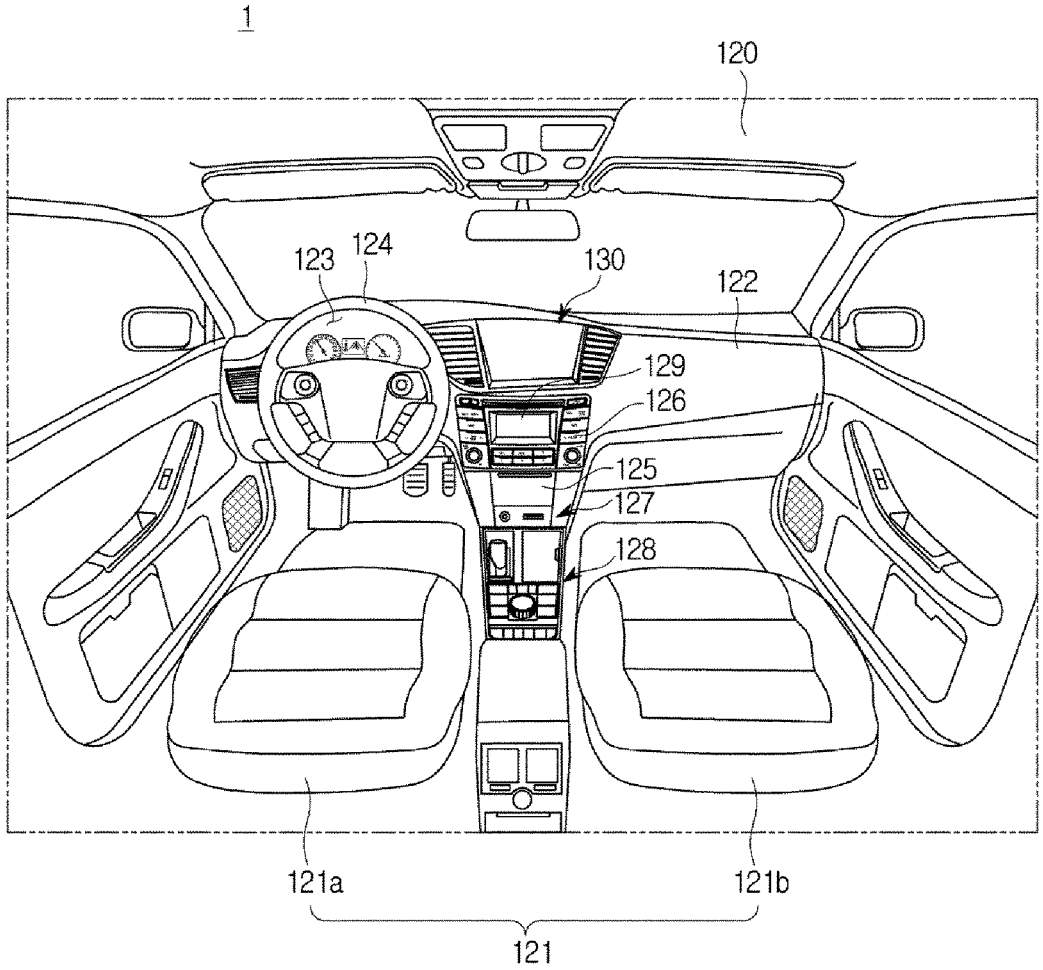
FIG. 2 is an exemplary view of an interior of the vehicle of FIG. 1.

FIG. 1 is an exemplary view of a vehicle, in which an antenna in accordance with an embodiment in the present disclosure is provided, and FIG. 2 is an exemplary view of an interior of the vehicle of FIG. 1.

A vehicle 1 may be a driving apparatus in order to transfer people and cargo by driving a vehicle wheel, and may travel on the road.

The vehicle 1 may include a body having an interior and an exterior, and a chassis, which is the rest of the vehicle, aside from the body, and in which a mechanical apparatus needed for driving is installed.

As illustrated in FIG. 1, an exterior 110 of the body may include a front panel 111, a bonnet 112, a roof panel 113, a rear panel 114, a trunk 115, and front, rear, left, and right doors 116.

The exterior 110 of the body may further include: window glasses 117 provided between the front panel 111, the bonnet 112, the roof panel 113, the rear panel 114, the trunk 115, and the front, rear, left, and right doors 116; and pillars 118 provided in the boundary between the front, rear, left, and right window glasses 117.

The window glasses 117 provided in the front, rear, left, and right doors 116 may further include: a quarter window glass installed between a side window glass and the pillars 118 to be unopenable; a rear window glass installed in a rear side of the vehicle; and a front window glass installed in a front side of the vehicle.

The exterior 110 may further include a side mirror 119 providing a rear side view of the vehicle to a driver.

The chassis of the vehicle may include a power generation device, a power transmission device, a driving device, a steering system, a brake system, a suspension device, a transmission device, a fuel system and front, rear, left and right vehicle wheels.

The vehicle may further include a variety of safety devices for the driver and passengers.

The safety devices of the vehicle may include a variety of safety devices, such as an air bag control device for the safety of the driver and passenger when the collision of the vehicle, and an electronic stability control (ESC) configured to maintain the stability of the vehicle when accelerating or cornering.

In addition, the vehicle 1 may further include a detection device, such as a proximity sensor configured to detect an obstacle or another vehicle in the rear or lateral side, and a rain sensor configured to detect whether to rain or the amount of rain.

The vehicle 1 may include an electronic control unit (ECU) configured to control the operation of the power generation device, the power transmission device, the driving device, the steering system, the brake system, the suspension device, the transmission device, the fuel system, the variety of safety devices, and the variety of sensors.

The vehicle 1 may include electronic devices such as a hand-free device, a GPS, an audio device, a bluetooth device, a rear camera, a device for charging terminal device, and a high-pass device, all of which are installed for the convenience of the driver.

The vehicle 1 may further include an ignition button configured to input an operation command to an ignition motor (not shown).

That is, the vehicle 1 may drive the ignition motor (not shown) and then drive an engine (not shown), which is a power generation device, through the operation of the ignition motor, when the ignition button is turned on.

The vehicle 1 may further include a battery (not shown) which is electrically connected to a terminal device, an audio device, an interior light, an ignition motor, and other electronics to supply a power electricity.

The battery may perform charging by using a power of the self-generator or the engine while the vehicle drives.

The vehicle 1 may further include an antenna apparatus 200 provided in the roof panel 113 to receive a radio signal, a broadcast signal, and a satellite signal, and to transmit and receive a signal to and from another vehicle, a server, and a base station.

The antenna 200 will be described later.

As illustrated in FIG. 2, the interior 120 of the body may include a seat 121 having 121*a* and 121*b* on which a passenger is seated; a dashboard 122; an instrument panel that is a cluster 123; a steering wheel 124 to change the direction of the vehicle; and a center fascia 125 in which an operation panel of the audio device and the air conditioning device are installed. The instrument panel may be disposed on the dashboard and may include tachometer, speedometer, coolant temperature indicator, fuel indicator, turn signal indicator, high beam indicator light, warning lights, seat belt warning light, trip odometer, odometer, automatic transmission selector lever indicator, door open warning light, oil warning light, and a low fuel warning light.

The seat 121 may include the driver seat 121*a* on which a driver is seated, the passenger seat 121*b* on which a passenger is seated, and a rear seat provide in a rear side of the inside of the vehicle.

The cluster 123 may be implemented in a digital manner. The cluster 123 in the digital manner may display vehicle information and driving information as an image.

The center fascia 125 may be disposed between the driver seat 121*a* and the passenger seat 121*b* on the dashboard 122, and may include a head unit 126 configured to control the audio device, the air conditioning device and a hot-wire in the seat 121.

The head unit 126 may include a plurality of buttons to receive an input of an operation command for the audio device, the air conditioning device, and the hot-wire in the seat.

In the center fascia 125, an air outlet, a cigar jack, and a multi-terminal 127 may be installed.

The multi-terminal 127 may be disposed adjacent to the head unit 146, and may further include a USB port, an AUX terminal, and a SD slot.

The vehicle 1 may further include an input 128 configured to receive an operation command of a variety of functions, and a display 129 configured to display information related to a function currently performed, and information input by a user.

The input 128 may be disposed on the head unit 126 and the center fascia 125, and may include at least one physical button such as an On/Off button for the variety of functions, and a button to change a set value of the variety of functions.

The input 128 may transmit an operation signal of the button to the ECU, a controller in the head unit 126, or the terminal 130.

The input 128 may include a touch panel integrally formed with a display unit of the terminal 130. The input 128 may be activated and displayed as the shape of the button on the display unit of the terminal 130, and may receive an input of the location information of the button displayed.

The input 128 may further include a jog dial (not shown) or a touch pad to input a command for moving cursor and selecting cursor, wherein the cursor is displayed on the display unit of the terminal 130.

The jog dial or touch pad may be provided in the center fascia.

Particularly, the input 128 may be capable of receiving any one of input of a manual driving mode, in which a driver directly drives a vehicle, and an autonomous driving mode, and may transmit an input signal of the autonomous driving mode to the ECU when the autonomous driving mode is input.

When a navigation function is selected, the input 128 may receive an input of information related to the destination, transmit the input destination to the terminal 130, and when a digital multimedia broadcasting (DMB) function is selected, the input 128 may receive an input of information related to the channel and sound volume, and transmit the input channel and sound volume to the terminal 130.

The terminal 130, which is configured to receive information from a user and configured to output a result corresponding to the input information, may be provided in the center fascia 125.

The terminal 130 may perform at least one function of a navigation function, a DMB function, an audio function, and a video function, and may display information related to the road condition and the driving during the autonomous driving mode.

The terminal may be installed on a dash board.

Figure 3:
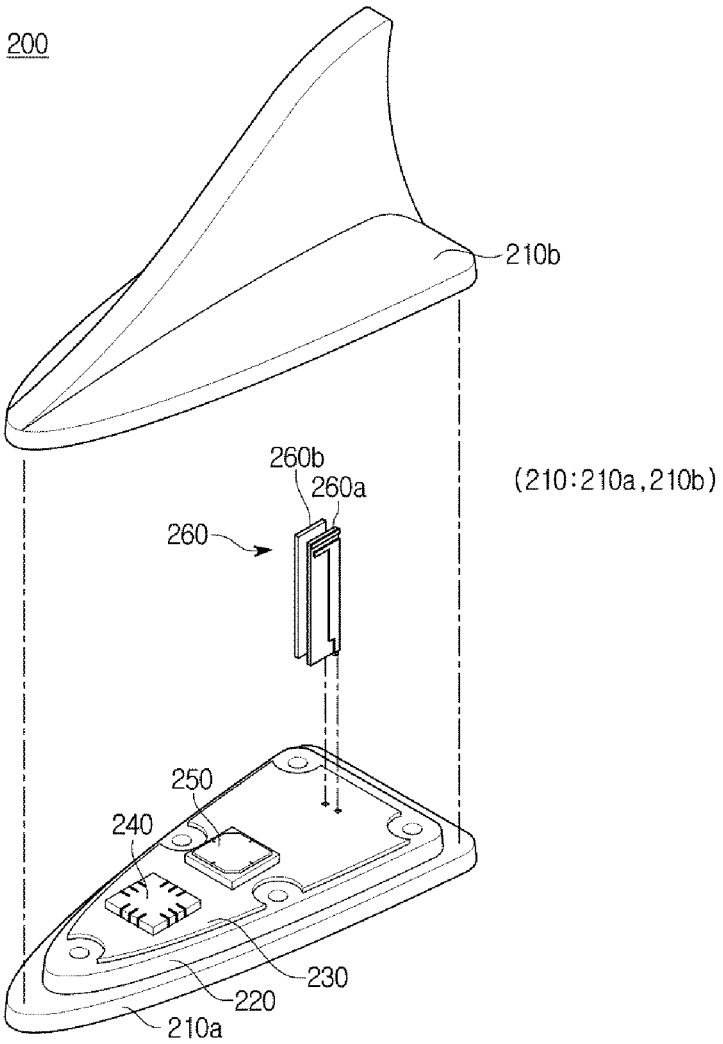
FIG. 3 is an exploded perspective view of an antenna apparatus in accordance with an embodiment in the present disclosure.

FIG. 3 is an exemplary view of an antenna apparatus in accordance with an embodiment in the present disclosure.

As illustrated in FIG. 3, the antenna apparatus 200 may include a housing 210 including a bottom member 210*a* mounted to the roof panel 112 of the body and a cover member 210*b* coupled to the bottom member 210*a* and configured to cover internal components.

The bottom member 210*a* may be formed by including synthetic resins, and mounted to the body so that foreign material may be prevented from being introduced into with the cover member 210*b*, and relieve a shock delivered from the body.

The bottom member 210*a* may be installed in a rear side of an upper portion of the vehicle so that interference with adjacent components may be less and thus the reception rate of radio signal may be secured.

The bottom member 210*a* may have a shape having the cross-sectional area thereof being increased as being toward the rear side, and thus, the wind resistance and the noise, both of which are generated when the body moves, may be reduced.

The housing 210 may be provided in a shark fin type.

The antenna apparatus 200 may include a base member 220 disposed in the bottom member 210*a*, and a driving module 230 disposed in the base member 220.

The base member 220 may be coupled to the bottom member 210*a* in a bonding or bolting manner, and may be coupled to the driving module 230 in a bolting manner.

The base member 220 may provide a space to which the driving module 230 and a plurality of antennas 240, 250, and 260 are mounted.

The driving module 230 may be provided as a printed circuit board (PCB) having a wiring formed by a cooper in an etching manner on a substrate.

The driving module 230 may include a hole in which a wire is penetrated.

The driving module 230 may include a signal process circuit to process a signal in a way of amplifying or filtering a signal received through the plurality of antennas 240, 250 and 260, respectively.

The signal process circuit for the plurality of antennas may be separately provided from the antenna.

The driving module 230 may transmit a signal the controller (ECU) mounted on an inside of the body or the terminal.

The driving module 230 may extract a radio, TV, or DMB broadcast signal and optimize the signal.

The driving module 230 may be implemented as a single integrated reception module by mounting an AM/FM tuner, digital signal processor (DSP), and microcomputer typically designed in the head unit, to a circuit board.

A first antenna 240 may be attached to the driving module 230.

The first antenna 240 may receive a signal in the first frequency band, e.g. a signal of GPS and DMB band.

That is, the first antenna 240 may receive a signal from a GPS satellite. The first antenna 240 may include a GPS receiver.

The first antenna 240 may be formed in a ceramic dielectric patch antenna type, and may be mounted on the driving module 230. The first antenna 240 may transmit the received GPS signal to the driving module 230 through a feed pin.

At this time, the driving module 230 may transmit a GPS signal received by the GPS receiver to the terminal.

A second antenna 250 may be mounted on the driving module 230 to be spaced apart from the first antenna 240.

The second antenna 250 may receive a signal in the second frequency band, e.g. a signal of FM/AM band.

The second antenna 250 may be implemented by a variety of antennas, e.g. a coil antenna, a chip antenna, and a micro strip patch antenna.

A third antenna 260 may receive a signal in the third band, which is from 5850 MHz to 5925 MHz.

The third antenna 260 may be coupled to the driving module 230 through a pattern unit 262 formed in a substrate 261.

A signal received by the third antenna 260 may be provided to the driving module 230, and a feed signal provided to the third antenna 260 may be supplied from the driving module 230.

The third antenna 260 may be a patch antenna.

Two third antennas 260: 260*a* and 260*b* may be provided.

The two third antennas 260: 260*a* and 260*b* may be vertically disposed in the driving module 230. Particularly, the two antennas 260: 260*a* and 260*b* may be spaced apart from the first antenna and the second antenna with a distance, which is to avoid the interference therebetween, and may have the same structure. Therefore, a single third antenna 260*a* will be described with reference to FIGS. 4 and 5.

A distance between two third antennas 260*a* and 260*b* may be to avoid the interference with each other, and may be acquired by an experiment.

Figure 4:
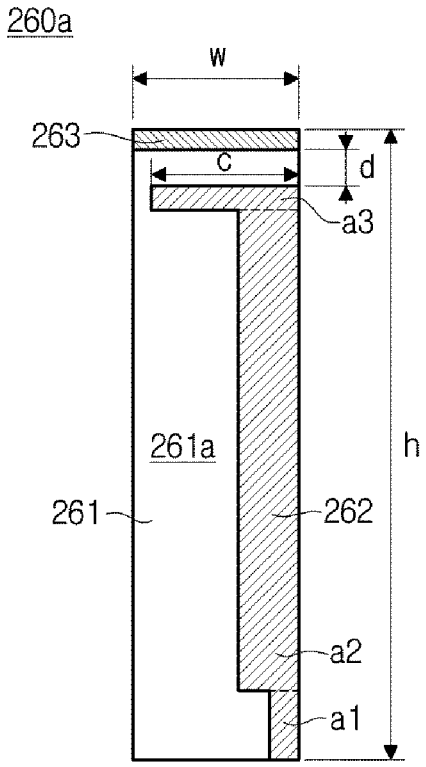
FIG. 4 is an exemplary view of a first surface of a third antenna provided in an antenna apparatus in accordance with an embodiment in the present disclosure.
Figure 5:
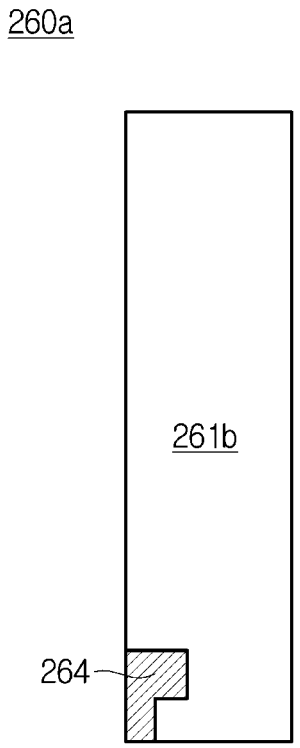
FIG. 5 is an exemplary view of a second surface of a third antenna provided in an antenna apparatus of FIG. 4.

As illustrated in FIG. 4, the third antenna 260*a* may include a substrate 261 formed of a dielectric material, a pattern unit 262, which is formed of conductive material, disposed on a first surface 261*a* of the substrate 261 and radiating an energy of electromagnetic wave. A patch unit 263, which is disposed on the substrate 261, is spaced apart from a side of the pattern unit 363 with a certain distance (d), and limits the radiation of the energy radiated from the one side of the pattern unit 262.

The third antenna 260*a* may further include a ground plate 264, which is provided in a second surface 261*b* of the substrate 261, formed of conductive material and connected the driving module.

The substrate 261 may be formed of synthetic resin having a dielectric constant above a certain level, such as glass epoxy, poly oxy methylene (POM), poly acetal, acrylonitrile butadiene styrene (ABS) resin, or poly carbonate (PC) resin.

The pattern unit 262 may include a first pattern (a1) connected to the driving module 230, a second pattern (a2) connected the first pattern (a1), and a third pattern (a3) connected to the second pattern (a2).

The first pattern (a1) may have a first width length and a first height length, the second patter (a2) may have a second width length and a second height length, and the third patter (a3) may have a third width length and a third height length.

At this time, the third width length may be longer than the second width length, the second width length may be longer than the first width length, and the third height length may be shorter than the second height length.

The patch unit 263 may be disposed to be close to the third pattern (a3) of the pattern unit 262 while being spaced apart from the third pattern (a3) of the pattern unit 262 with a certain distance (d).

The patch unit 263 may be disposed on an upper side of an open unit of the third antenna so that the reflection of radiant energy may be acquired.

The certain distance (d) may be determined based on a height length (h) of the pattern unit, a width length of the patch unit 263, and the third width length (c) of the third pattern (a3).

When a height length (h) of the pattern unit is approximately 31.6 mm, and a width length (w) of the patch unit 263 is approximately 9.6 mm, a certain distance (d) may be from approximately 1 mm to approximately 2.1 mm.

The distribution of the current flow may vary according to the certain distance.

Figure 6A:
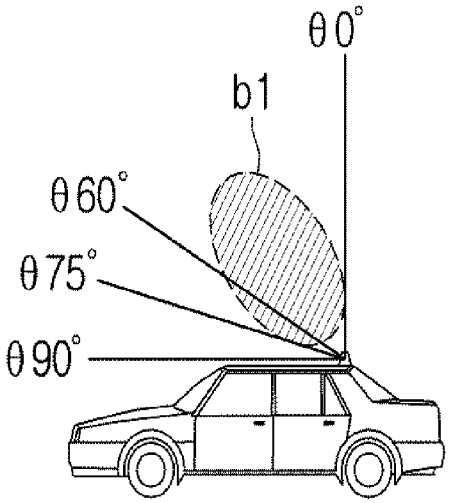
FIGS. 6A and 6B are exemplary views of a radiant energy pattern of a third antenna provided in an antenna apparatus in accordance with a related art and an embodiment in the present disclosure.
Figure 6B:
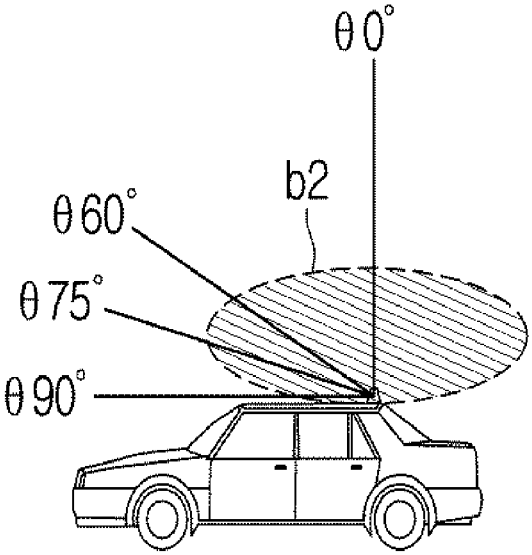
Figure 7A:
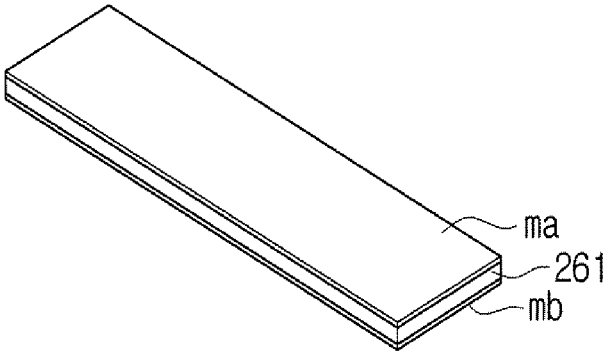
FIGS. 7A-7E are a flow chart of a method for manufacturing a third antenna provided in an antenna apparatus in accordance with an embodiment in the present disclosure.
Figure 7B:
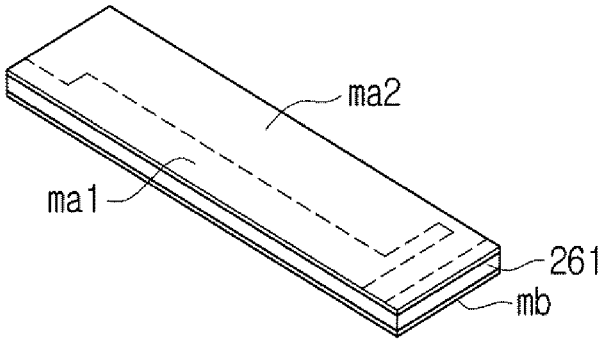
Figure 7C:
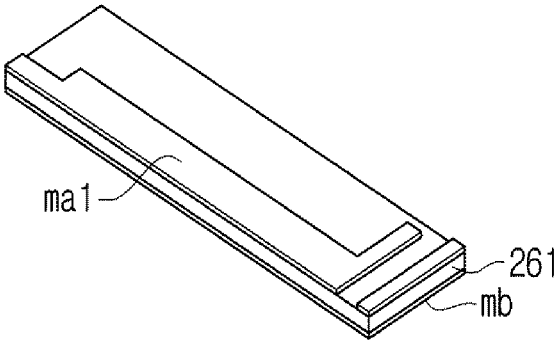
Figure 7D:
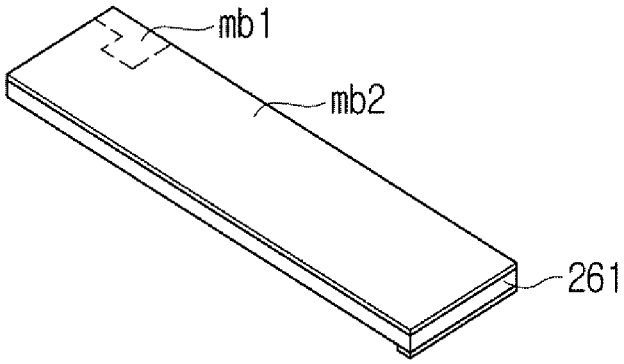
Figure 7E:
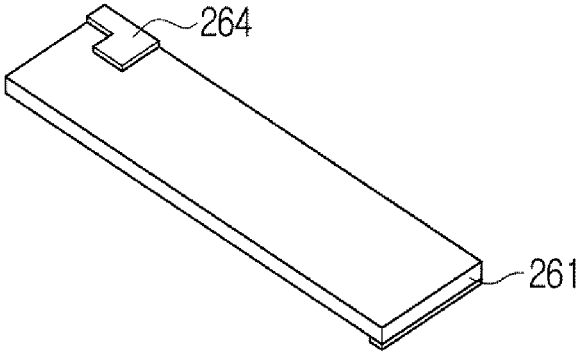

As illustrated in FIGS. 6A and 6B, the radiant energy may be tilted by the patch unit disposed with the certain distance, and the radiant energy may be focused on the front side, the rear side of the vehicle, and by focusing under a certain angle, which are needed for V2X service so that attenuation effect may be minimized and the radiation area may be increased.

A conventional radiant energy pattern (b1) may be formed between approximately 0 degree and approximately 60 degree. However, according to an embodiment, a radiant energy pattern (b2) may be formed between approximately 75 degree and approximately 90 degree.

Therefore, a radiant energy pattern may be optimized in a horizontal direction of travel of the vehicle, and thus, an effective communication distance may be easily secured.

FIGS. 7A-7E are a flow chart of a method for manufacturing a third antenna provided in an antenna apparatus in accordance with an embodiment in the present disclosure.

At first, the substrate 261 having a thin film (ma and mb) formed opposites of thereof may be prepared. The thin film (ma and mb) may be a metal film formed of conductive material.

The pattern unit and the patch unit may be designed on the first surface of the substrate 261.

In the thin film of the first surface of the substrate 261, a rest area (ma2) of a first design area (ma1) in which the pattern unit and the patch unit are designed, may be removed, and thus the pattern unit and the patch unit may be formed on the first surface of the substrate.

When removing the remaining area of the first surface, a masking process may be performed on the first design area (ma1), and the remaining area (ma2) may be removed by an etching technology. Accordingly, the substrate may be exposed to the outside. That is, a portion corresponding to the remaining area (ma2) in the first surface of the substrate may be exposed.

In addition, designing the pattern unit and the patch unit may include designing the pattern unit to be spaced apart from the patch unit with a certain distance.

A ground plate may be designed on a thin film of the second surface of the substrate.

In the thin film of the second surface of the substrate, a rest area (mb2) of a second design area (mb1) in which the ground plate is designed, may be removed, and thus the ground plate 264 may be formed on the second surface of the substrate.

When removing the remaining area of the second surface, a masking process may be performed on the second design area (mb1), and the remaining area (mb2) may be removed by an etching technology. Accordingly, the substrate may be exposed to the outside. That is, a portion corresponding to the remaining area (mb2) in the second surface of the substrate may be exposed.

A third antenna manufactured as mentioned above, is a kind of a microstrip antenna, and when vertically mounted to the driving module, the third antenna may receive and transmit a signal by using a principal in which a microstrip line having an upper surface thereof open radiates a high frequency through an open surface.

The third antenna may be configured in a way that the second surface of the dielectric substrate is a ground plate and the first surface is a strip line or a slot line and thus the third antenna may be manufactured as a PCB. Accordingly, the third antenna may be easily manufactured and may be suitable for mass production. In addition the third antenna may have a low height and the durability.

Figure 8:
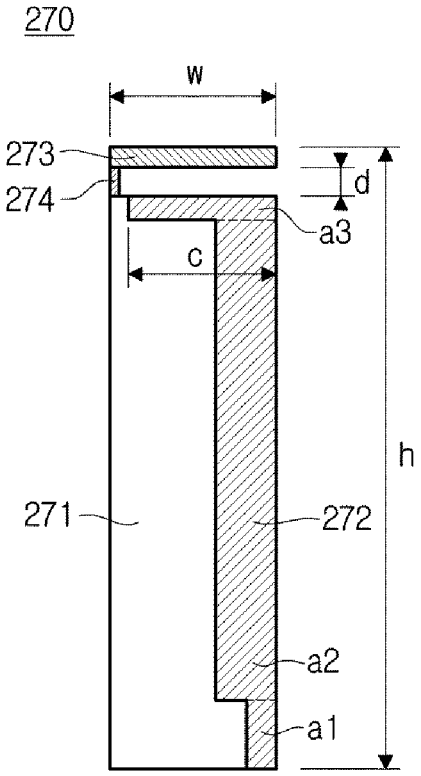
FIG. 8 is another exemplary view of a third antenna provided in an antenna apparatus in accordance with an embodiment in the present disclosure.

FIG. 8 is another exemplary view of a third antenna provided in an antenna apparatus in accordance with an embodiment in the present disclosure.

As illustrated in FIG. 8, a third antenna 270 may include a substrate 271 formed of a dielectric material, a pattern unit 272, which is formed of conductive material, disposed on a first surface of the substrate 271 and configured to radiate an energy of electromagnetic wave, a patch unit 273 disposed to be spaced apart from a side of the substrate 271 and configured to limit the radiation of the energy radiated from the one side of the pattern unit 272, and a supporting unit 274 configured to fix the patch unit to the substrate so that the substrate is spaced apart from the patch unit with a certain distance.

The supporting unit 274 may be separated from the substrate.

A height of the supporting unit 274 may be adjusted to adjust a distance between the substrate 271 and the patch unit 273.

The third antenna 270 may further include a ground plate (not shown), which is provided in a second surface of the substrate 271, formed of conductive material. The ground plate may be connected the driving module.

The pattern unit 272 may include a first pattern (a1) connected to the driving module 230, a second pattern (a2) connected the first pattern (a1), and a third pattern (a3) connected to the second pattern (a2).

The first pattern (a1) may have a first width length and a first height length, the second patter (a2) may have a second width length and a second height length, and the third patter (a3) may have a third width length and a third height length.

At this time, the third width length may be longer than the second width length, the second width length may be longer than the first width length, and the third height length may be shorter than the second height length.

The patch unit 273 may be disposed to be close to the third pattern of the pattern unit 272 while being disposed to be spaced apart from the third pattern of the pattern unit 272 with a certain distance (d).

By mounting the patch unit to an upper side of an open unit of the third antenna, reflection effect of antenna radiant energy may occur.

The certain distance (d) may be determined based on a height length (h) of the pattern unit, a width length of the patch unit 273, and the third width length (c) of the third pattern (a3).

When a height length (h) of the pattern unit is approximately 31.6 mm, and a width length (w) of the patch unit 273 is approximately 9.6 mm, a certain distance (d) may be from approximately 1 mm to approximately 2.1 mm.

The distribution of the current flow may vary according to the certain distance.

The radiant energy may be tilted by the patch unit disposed with the certain distance, and the radiant energy may be focused on the front side, the rear side of the vehicle, and by focusing under a certain angle, which are needed for V2X service so that attenuation effect may be minimized and the radiation area may be increased.

A conventional radiant energy pattern (b1) may be formed between approximately 0 degree and approximately 60 degree, but according to an embodiment, a radiant energy pattern (b2) may be formed between approximately 75 degree and approximately 90 degree.

Therefore, a radiant energy pattern may be optimized in a horizontal direction of travel of the vehicle, and thus an effective communication distance may be easily secured.

Figure 9:
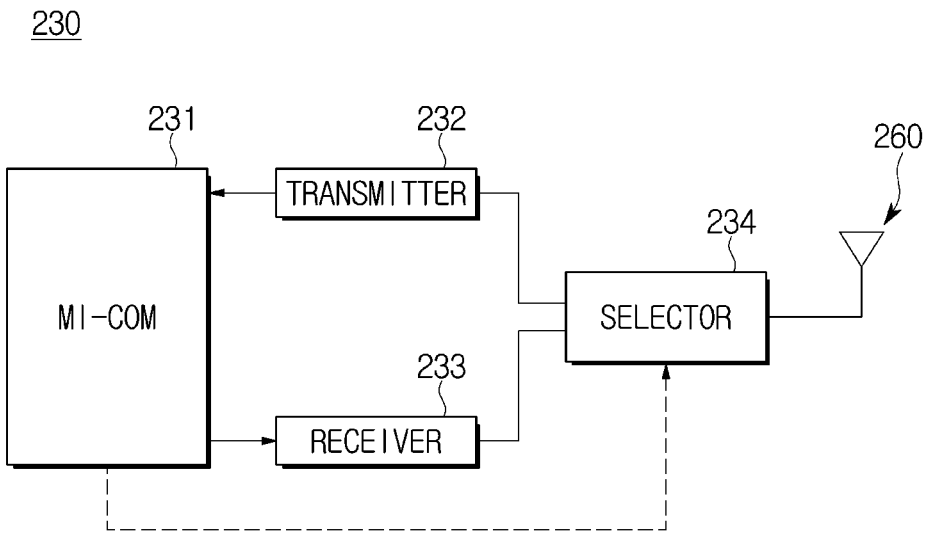
FIG. 9 is a control block diagram of a driving module provided in an antenna apparatus in accordance with an embodiment in the present disclosure.

A configuration of a driving module 230 to transmit and receive a signal by using a third antenna will be described with reference to FIG. 9.

A driving module 230 of an antenna 200 may include a microcomputer 231, a transmitter 232, a receiver 233, and a selector 234.

The transmitter 232 may convert digital transmission data into a transmission signal of low frequency, and may transmit the transmission signal of low frequency to the third antenna 260 through the selector 234.

The receiver 233 may convert the received reception signal of low frequency into digital reception data, and may output the digital reception data to the microcomputer 231.

The third antenna 260 may radiate a transmission signal received from the selector 234 to a free space, and may provide the reception signal received from the free space to the selector 234.

The selector 234 may select the transmitter or the receiver according to a selection signal of the microcomputer 231. The selector 234 may provide a transmission signal to the third antenna by receiving the transmission signal through the selected transmitter or may receive a transmission signal of the antenna through the selected receiver.

Figure 10:
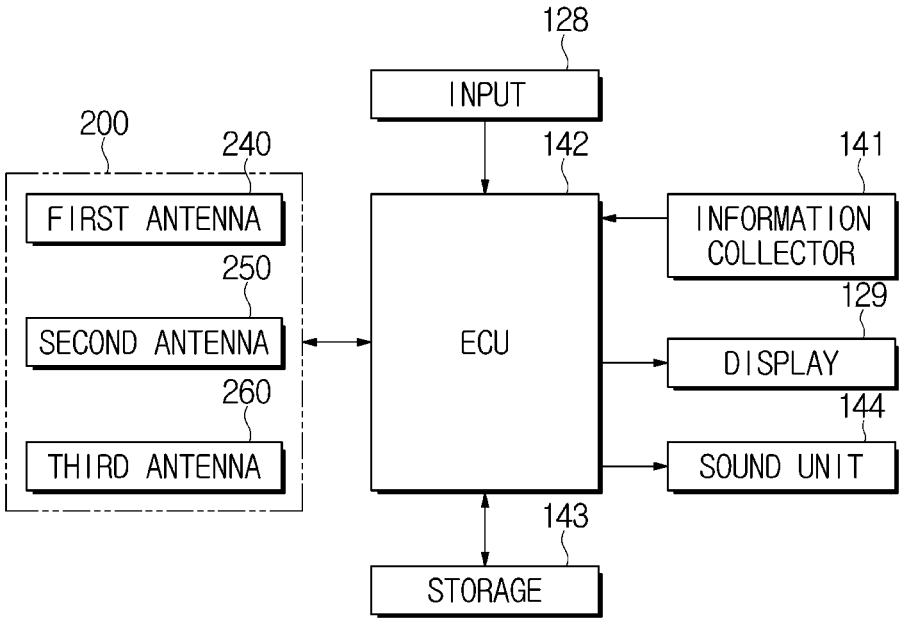
FIG. 10 is a control block diagram of a vehicle in which an antenna apparatus in accordance with an embodiment in the present disclosure is provided.

FIG. 10 is a control block diagram of a vehicle in which an antenna apparatus in accordance with an embodiment in the present disclosure is provided.

The input 128 may receive an input of a mode among a manual driving mode, an autonomous driving mode, and a warning mode to inform the recognition of an obstacle.

The input 128 may receive a destination input during the autonomous driving mode.

By the control of a controller 142, the display 129 may display image information generated during performing a program, e.g., a variety of menu image information, digital broadcast image information, and navigation image information, the outside image information related to the front side of the vehicle, and road condition information related to the current location and the destination.

The display 129 may display information related to a current driving mode and the destination.

The information related to the destination may include address information, total distance information, total time information, remaining distance information, and remaining time information.

An information collector 141 may collect driving information and road condition information, and may include at least one of a distance detector and an image detector.

The distance detector may detect a signal to detect an object placed in outside of the vehicle, e.g. a front vehicle driving in the front side of the vehicle, and a stationary object, e.g. a structure installed in adjacent to the road, and a vehicle coming from an opposite lane.

That is, the distance detector may output a signal corresponding to detecting an object in the front of the vehicle and in the lateral side of the vehicle, from the current location, and may transmit a signal corresponding to a distance from the detected object, to a controller of an object recognition device.

The distance detector may include a light detection and ranging (LiDAR) sensor.

The LiDAR sensor may be a distance detection sensor in a non-contact manner by a laser radar principal.

The LiDAR sensor may include a transmitter transmitting laser and a receiver receiving laser reflected from a surface of an object placed in the sensor range.

The laser may be a single laser pulse.

The distance detector may include an ultrasound sensor and a radar sensor.

The ultrasound sensor may generate ultrasonic waves for a certain period of time and may detect a signal reflected from an object.

The ultrasound sensor may determine the presence of an obstacle, e.g. a pedestrian in the short distance range.

The radar sensor may detect a position of an object by using reflected waves generated by the electromagnetic wave radiation when the transmission and the reception are performed at the same place.

In order to prevent the difficulty to distinguish received radio waves from transmitted radio waves because of being overlapped with each other, the radar sensor may use the Doppler effect, may change a frequency of transmission radio wave according to the time, or output pulse waves as the transmission radio wave In addition, since the LiDAR sensor has the high detection accuracy in a horizontal direction in comparison with a radio detecting and ranging (RaDAR) sensor, the accuracy of a process of determining whether a tunnel is existed in the front may increase.

The image detector may detect object information and convert the object information into an electric image signal. The image detector may detect object information placed in the outside of the vehicle, e.g. a road in which the vehicle drives, and the front and lateral sides of the vehicle, and may transmit an image signal of the detected object information to the controller 142.

The image detector may include a front camera configured to acquire an image in the front side of the vehicle, and at least one of a left side camera and right side camera configured to acquire an image of the lateral side of the vehicle, and a rear camera configured to acquire an image of the rear side of the vehicle.

The information collector of the vehicle 1 may further include a rain detector detecting whether to rain and an amount of rain, a wheel speed detector detecting a speed of the vehicle wheel, an acceleration detector detecting an acceleration of the vehicle, and an angular speed detector detecting a steering angle of the vehicle.

The controller 142 may check driving information related to the vehicle and road condition information, and may control the transmission of the checked driving information and road condition information.

The controller 142 may control to display road condition information received through the antenna apparatus.

The road condition information received through the antenna apparatus may be information transmitted from another vehicle or a server.

The controller 142 may perform the autonomous driving mode based on the checked driving information and road condition information and the received road condition information.

During the autonomous driving mode, the controller 142 may confirm destination information, may search a route to the destination from the current location based on the confirmed destination information, and may control a driving device (not shown) based on the searched route.

The controller 142 may control at least one of a power generation device that is a driving device (not shown), a power transmission device, a driving device, a steering system, a brake system, a suspension device, a transmission device, and a fuel system.

The controller 142 may re-search a route to the destination based on the checked driving information and road condition information, and the received road condition information, and may control to display the checked driving information, and road condition information, and the received road condition information.

The controller 142 may perform the radio function, the DMB broadcast function and the navigation function by communicating with the first antenna and the second antenna.

When performing the navigation function, the controller 142 may estimate the current location of the vehicle based on location information received through the first antenna 240 of the antenna apparatus, display the estimated location by map matching on the stored map data, perform searching a route to a destination from the estimated current location according to a predetermined route search algorism by receiving the destination from a user, display the searched route by matching to the map, and guide the user to the destination according to the route.

When performing the radio function, the controller 142 may control to output a radio broadcast by using a radio signal received through the second antenna 250 of the antenna apparatus.

The controller 142 may be a central processing unit (CPU), microcontroller (MCU), or a processor.

The controller 142 may be an ECU provided in the vehicle.

The vehicle may further include a communication device to communicate with an antenna apparatus.

The communication device may include CAN communication module, a Wi-Fi communication module, a USB communication module, and a Bluetooth communication module.

A storage 143 may store an application program for the operation of the object recognition function and for the autonomous driving mode.

The storage 143 may be include a volatile memory, e.g. static RAM (S-RAM) and dynamic RAM (D-RAM), and a non-volatile memory, e. g. a flash memory, a read only memory (ROM), erasable programmable read only memory (EPROM), and electrically erasable programmable read only memory (EEPROM).

The controller 142 may control the operation of the driving device (not shown), an output that is the display 129 and a sound unit 144 based on the driving information and the road condition information.

The controller 142 may determine the presence of the obstacle in the driving road based on the road condition information, and may determine that the obstacle is not belong to the driving road when the obstacle is not existed in the driving road.

The output 129 and 144 may warn a driver, a driver of another vehicle, or a pedestrian to prevent a collision between vehicles and between a vehicle and a pedestrian.

The output may warn a risk by using the audio, or a visible light, and may warn a driver of a risk through a variety of means, e.g. vibrating a steering wheel or a seat if there is a risk of collision.

The controller 142 may control the brake device to avoid the collision with another vehicle and a pedestrian, or may control the steering system to change the direction to the left side and the right side to prevent the accident.

The sound unit 144 may output the driving information, the road condition information and the warning sound as a sound.

Figure 11:
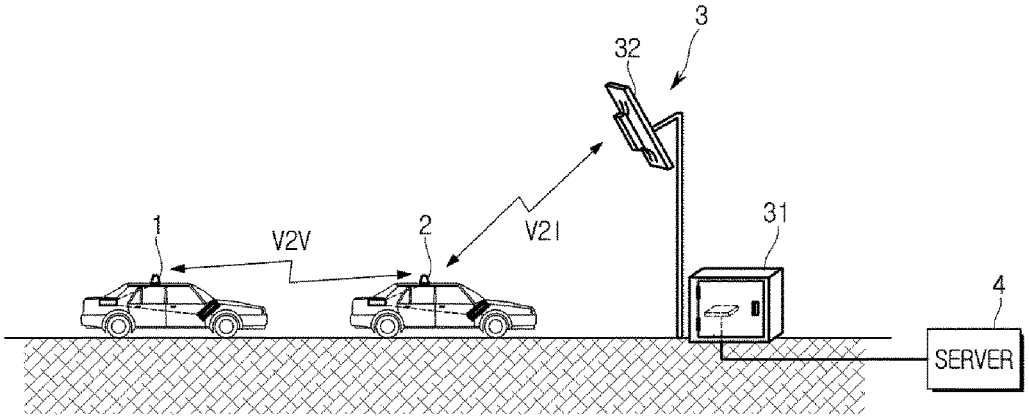
FIGS. 11 and 12 are exemplary views of a communication of a vehicle in which an antenna apparatus in accordance with an embodiment in the present disclosure is provided.
Figure 12:
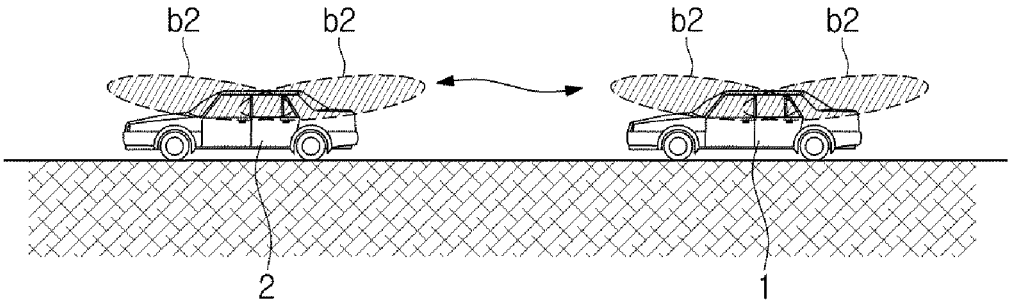

FIGS. 11 and 12 are exemplary views of a communication of a vehicle in which an antenna apparatus in accordance with an embodiment in the present disclosure is provided.

FIG. 11 is a view illustrating a communication between a first vehicle 1 and a second vehicle 2 that is another vehicle, and communication among the vehicles 1 and 2, a base station 3, and a server 4.

The first vehicle 1 may radiate an electromagnetic wave to the outside through the antenna apparatus 200.

In this case, the antenna apparatus 200 may radiate a corresponding electromagnetic wave based on an electrical signal transmitted from the controller provided in the first vehicle 1.

The second vehicle 2 may receive an electromagnetic wave, which is radiated through the antenna apparatus 200 of the first vehicle 1, through the third antenna 260.

The driving module of the antenna apparatus may demodulate the received electromagnetic wave and convert it into an electrical signal, and may transmit the electrical signal to the controller.

At this time, the controller of the vehicle may generate a control signal corresponding to the electrical signal and may use it for the control of the second vehicle 2.

In contrast, the third antenna 260 of the second vehicle 2 may generate an electrical signal based on a control signal transmitted from the controller of the second vehicle 2, and radiate a corresponding electromagnetic wave based on the electrical signal.

The vehicle 1 may receive the electromagnetic wave radiated from the second vehicle 2 through the antenna apparatus 200, and may convert the received electromagnetic wave into an electrical signal.

The first vehicle 1 may generate a control signal corresponding to the electrical signal and may use it for the control of the first vehicle 1. Accordingly, vehicle to vehicle (V2V) communication may be performed.

In the base station 3 or the server 4 of the road, an antenna apparatus 32 configured to receive an electromagnetic wave radiated from the antenna apparatus 200 of the vehicle or configured to radiate an electromagnetic wave, may be disposed.

According to an embodiment, the antenna apparatus 32 installed in the base station 3 may receive and transmit a signal through a controller 31, as mentioned above.

The controller 31 may receive and transmit a control signal to and from the server 4.

The base station 3 of the road may receive an electromagnetic wave radiated from the antenna apparatus 200 of the first vehicle 1. An electrical signal corresponding to the received electromagnetic wave may be transmitted to the controller 31 that is separately provided.

The controller 31 may acquire information by using the received electrical signal or may generate a certain control signal.

The controller 31 may transmit an electrical signal, a control signal that is generated according to the electrical signal, and information acquired based on the electrical signal to the server 4 of the outside via a separate cable 38.

The controller 31 of the base station 3 may transmit a certain control signal or information to the antenna apparatus 32 of the base station 3, and the antenna apparatus 32 may radiate an electromagnetic wave corresponding to the certain control signal or information.

In this case, the antenna apparatus 200 of the first vehicle 1 may receive an electromagnetic wave transmitted through the antenna apparatus 32 of the base station 3. The controller of the first vehicle 1 may generate a control signal about a variety of components of the first vehicle 1, e.g. a display device, based on an electrical signal corresponding to the received electromagnetic wave, and may transmit the control signal to the each component of the first vehicle 1.

Accordingly, a vehicle to infrastructure (V2I) communication may be performed.

As illustrated in FIG. 12, when the above-mentioned antenna apparatus 200 is installed, the antenna 200 may radiate an electromagnetic wave (b2) to focus on the front side and the rear side of the first vehicle 1 and the second vehicle 2, and thus, energy consumption may be reduced and a communication available range of the front side or the rear side may extend.

In addition, the electromagnetic wave (b2) may be more intensively radiated, and thus, a signal attenuation effect caused by a dashboard, a wind shield, or a vehicle frame may be reduced.

As is apparent from the above description, according to the proposed antenna apparatus, method for manufacturing the same, vehicle having the same, by providing a parasitic patch on a side of a pattern unit, a radiant energy may be tilted and the eccentricity of radiant energy may be improved.

By tilting radiant energy, the radiant energy may be focused below a certain angle in the front side and the rear side of the vehicle, a signal attenuation effect may be reduced, and the radiation area may extend.

In addition, the radiation area may be horizontally extended, and a communication performance with another vehicle placed in the front side and the rear side may be improved.

The quality and the marketability of the vehicle having an autonomous driving mode may be improved, a user satisfaction may be increased, the user convenience and the safety of the vehicle may be enhanced, and the competitiveness of the vehicle may be secured.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. An antenna apparatus comprising:

a substrate formed of a dielectric material;

a pattern unit disposed on a first surface of the substrate and radiating energy of electromagnetic wave; and a patch unit disposed on the substrate and spaced apart from one side of the pattern unit with a first distance and tilting a radiation area of energy radiated from the one side of the pattern unit to an angle smaller than a predetermined angle toward front and rear sides of a vehicle, wherein the first distance is determined based on a height of the pattern unit and a width of the patch unit, wherein the width of the patch unit is longer than a width of the pattern unit, and wherein the first distance is between 1 mm and 2.1 mm, inclusive, the height of the pattern unit is approximately 31.6 mm, and the width of the patch unit is approximately 9.6 mm.

2. The antenna apparatus of claim 1 further comprising:

a ground plate disposed on the first surface and a second surface of the substrate, the ground plate including a conductive material.

3. The antenna apparatus of claim of 1 wherein the pattern unit comprises:

a first pattern connected to a driving module;

a second pattern having a longer width and a longer height than those of the first pattern; and a third pattern having a longer width and a shorter height than those of the second pattern.

4. The antenna apparatus of claim of 3 wherein the patch unit is spaced apart from the third pattern with a second distance.

5. The antenna apparatus of claim of 1 further comprising:

a ground plate disposed on a second surface of the substrate; and a supporting unit disposed between the substrate and the patch unit.

6. A method for manufacturing an antenna apparatus, the method comprising:

designing a pattern unit and a patch unit on a first surface of a substrate which has a thin film on each of the first surface and a second surface of the substrate;

forming the pattern unit and the patch unit on the first surface of the substrate by removing a remaining area of a first design area in which the pattern unit and the patch unit are designed in the thin film of the first surface of the substrate;

designing a ground plate on the thin film of the second surface of the substrate; and forming the ground plate on the second surface of the substrate by removing a remaining area of a second design area in which the ground plate is designed, in the thin film of the second surface of the substrate, wherein a width of the patch unit is longer than a width of the pattern unit, wherein the step of designing the pattern unit and the patch unit comprises designing the pattern unit and the patch unit to be spaced apart from each other with a first distance so as to tilt a radiation area of energy radiated from the pattern unit, wherein the first distance is based on a height of the pattern unit and the width of the patch unit, and wherein the first distance is between 1 mm and 2.1 mm, inclusive, the height of the pattern unit is approximately 31.6 mm, and the width of the patch unit is approximately 9.6 mm.

7. The method of claim 6 wherein in the step of forming the ground plate on the second surface of the substrate, the remaining area of the first surface and the second surface is removed by an etching technology.

* * * * *